United States Patent [19]

Fukui

[11] Patent Number: 4,903,601

[45] Date of Patent: Feb. 27, 1990

[54] PROCESS FOR PRINTING CHARACTERS OR THE LIKE ON A THERMOPLASTIC RESIN MOLDING

[75] Inventor: Kiichiro Fukui, Fuji, Japan

[73] Assignee: Polyplastics Co., Ltd., Osaka, Japan

[21] Appl. No.: 266,830

[22] Filed: Nov. 3, 1988

[30] Foreign Application Priority Data

Nov. 16, 1987 [JP] Japan ..... 62-288664

[51] Int. Cl.[4] ..... B41F 17/00

[52] U.S. Cl. ..... 101/488; 427/378; 34/22

[58] Field of Search ..... 427/377, 378; 101/487, 101/488, 470, 483; 34/30, 51, 22, 23

[56] References Cited

U.S. PATENT DOCUMENTS

| | | | |
|---|---|---|---|
| 1,795,703 | 3/1931 | Baur | 427/378 |
| 1,867,405 | 7/1932 | Gurwick | 101/424.1 X |
| 2,907,118 | 10/1959 | Maescher | 101/424.1 X |
| 3,176,412 | 4/1965 | Gardner | 34/122 |
| 4,008,661 | 2/1977 | Mathis | 101/424.1 X |
| 4,132,590 | 1/1979 | Yamada et al. | 34/23 X |
| 4,369,584 | 1/1983 | Daane | 34/23 X |

FOREIGN PATENT DOCUMENTS

| | | | |
|---|---|---|---|
| 27611 | 8/1973 | Japan | 34/30 |

*Primary Examiner*—Clifford D. Crowder
*Attorney, Agent, or Firm*—Nixon & Vanderhye

[57] ABSTRACT

A molded article of a thermoplastic resin is printed by impressing characters, symbols or figures on a thermoplastic resin molding. These characters or the like are first printed upon a resin molding. A high-temperature compressed gas is then directed against the printed surface of the molding so that the temperature and pressure of said gas is between 100° to 300° C. and 0.05 to 5 kg/cm$^2$, respectively.

4 Claims, No Drawings

PROCESS FOR PRINTING CHARACTERS OR THE LIKE ON A THERMOPLASTIC RESIN MOLDING

FIELD OF INVENTION

This invention relates to an improved process for imprinting characters, symbols figures or the like (hereinafter simply referred to as indicia or the like) to a thermoplastic resin molding.

BACKGROUND AND SUMMARY OF INVENTION

It has become conventional to impart, specific functions, such as ornamentation or functional indication, to a molding prepared from a thermoplastic resin by forming indicia or the like on its surface.

Exemplary applications where functional indications are desired include uses where there is a high frequency of contact, such as the keys for personal computers, word processors, typewriters, desktop electronic calculators or telephone sets, or various switches and control levers of an automobile. These end use applications, especially require that the indicia characters or the like formed on the moldings surface exhibit wear-resistance, otherwise the indicia will fade due to repeated contact during use.

Since thermoplastic resins, especially, engineering plastics and crystalline thermoplastic resins are generally chemically stable (and thereby insufficiently reactive) and form moldings having hard and smooth surfaces, conventional printing processes, such as forming indicia or the like on the resin molding by screen printing, pad printing, or offset printing and then fixing the ink by drying at normal and at normal pressure, usually will not promote strong adhesion of the ink to the resin. Thus, conventional processes have been unable to meet the requirements described above even though they are satisfactory for end use applications where low durability is required. Furthermore, conventional processes are inefficient since a long time, usually 20 to 30 minutes, so as to fix the ink by drying at normal or elevated temperature.

Broadly, the present invention is directed to fixing indicia or the like on a resin molding by blowing a high-temperature compressed gas against the printed area as an aftertreatment.

More specifically, the present invention relates to a process for printing, characters or the like on a thermoplastic resin molding by forming them on the molding by printing, and then blowing a high-temperature compressed gas against the printed surface of the molding so that the temperature and pressure of the compressed gas is between 100° to 300° C. and 0.05 to 5 kg/cm$^2$, respectively, or the like so as to fix the indicia like thereto.

DETAILED DESCRIPTION OF PREFERRED EMBODIMENTS

According to the present invention, indicia or the like are first printed on a thermoplastic resin molding by a conventional printing process.

Although the printing process used is not particularly limited and any well-known printing processes, such as screen printing, pad printing and offset printing, may be used, pad printing is desirable in that it can easily be adapted to various kinds and forms of moldings or to various kinds of indicia or the like. Similarly, the coloring material for forming characters or the like is not particularly limited and thus may be dye ink, paint or the like. It is, however, is usually preferred to use an ink. Especially preferred is the use of an ink having good heat resistance or an ink classified as a thermosetting ink.

The coloring material, such as an ink, as initially applied to the surface of the resin molding merely adheres to the surface and thus is not strongly fixed thereto.

According to the present invention, a high-temperature compressed gas is then blown against the molding having the ink or the like initially applied thereto (and thus is not yet sufficiently fixed to the resin surface) such that the temperature and pressure of the compressed gas is between 100° to 300° C. and 0.05 to 5 kg/cm$^2$, respectively. The ink or the like can thus be strongly fixed to form indicia or the like of excellent durability on the surface of the molding.

When the temperature of the blown gas on the printed area is lower than the above-specified temperature, the line to dry ink or the like is inordinately long and thereby the process is inefficient and, the resulting molding exhibits poor ink fixation to the resin resulting in poor durability of the printed area. When the temperature is excessively high, on the contrary, undesirable discoloration or gloss reduction of the ink or the like or fusion, gloss reduction, distortion, etc. of the resin frequently occur frequently.

The gas temperature directed onto the printed area is therefore preferably 120° to 280° C., and most preferably, 150° to 250° C.

When the gas pressure on the printed area is excessively low, insufficient fixation of ink or the like to the resin occurs. On the other hand, when the pressure is excessively high, the ink or the like is spread outside the desired area and distortion or gloss reduction of the resin sometimes occurs at a rather high temperature. The desirable gas pressure on the printed area is therefore between 0.1 to 3 kg/cm$^2$.

The gas employed according to the present invention is not particularly limited (as long as it does not corrode and/or degrade the apparatuses, etc. used.). Thus, the gas may be oxygen, nitrogen, air, helium, carbon dioxide, and the like, with air being preferred due to its safety, economy, etc. High-temperature compressed gas can easily be prepared by compressing the gas with a compressor or the like and heating the compressed gas by passing it through a heater.

Blowing of such a high-temperature compressed gas is performed for, usually, 0.5 to 180 seconds this invention. An optional processing condition is selected, considering the thermal properties of the base resin, the properties of the ink or the like and the temperature, pressure, etc. of the high-temperature compressed gas. Although strong fixation of ink or the like to the resin can be generally attained in most cases by blowing a compressed gas at a temperature higher than the melting point, softening point or heat distortion temperature of the resin, there is a risk that fusion, distortion, etc. of the resin may occur when the compressed gas is in contact with the resin for prolonged time periods. Thus, blowing of the compressed gas is preferably performed for 1 to 120 seconds, particularly preferably, 1 to 60 seconds under such conditions.

The present invention is further characterized by forming indicia or the like by a usual printing process on a thermoplastic resin molding and then subjecting the printed molding to the specified after-treatment so as to impress the printed indicia or the like on to the thermoplastic resin molding. In this regard, the thermoplastic resin used is not particularly limited. Examples of the resins which can be used include polyethylene, polypropylene, polystyrene, polyacrylates, polymethacrylates, AS resin, ABS resin, poluurethane, polyacetal, polyesters (polyethylene terephthalate, polybutylene terephthalate, wholly aromatic polyester, etc.), polyamides, polycarbonates, polyphenylene sulfide, polyphenylene oxide, polysulfone, etc., products formed by modifying these resins as bases by copolymerization, graft polymerization or the like, which can be used alone or in the form a mixture of at least two of them.

In the case of a resin having a low melting point, heat distortion temperature or the like, blowing of a high-temperature compressed gas against it must be performed under relatively mild conditions, so that fixation effect of the ink or the like is slightly poorer as compared with that attained when the ink is applied to a higher melting point resin, even though the effect is still significantly improved as compared with that attained by conventional processes. On the contrary, in the case of a resin having a very high melting point, etc., blowing of a gas can be performed under relatively severe conditions, so that strong fixation of the ink or the like can be attained, even though there is a fear of discoloration of the ink or the like if prolonged contact between the gas and resin occurs, as mentioned previously.

Therefore, it is preferable that this invention is applied to a resin having a suitable melting point, a suitable heat distortion temperature or the like, and it is particularly effective to resins belonging to engineering plastics or crystalline thermoplastic resins, for example, various polyester resins (polyethylene terephthalate, polybutylene terephthalate, and other polyarylates), polyacetal resins, polyphenylene sulfide resins, polycarbonate and polyamide resins.

It is also possible according to the present within to add well-known additives and/or fillers to the base resin, for example, various stabilizers for improving oxidation resistance, heat resistance, weathering properties, etc., lubricants, plasticizers, nucleating agents, mold release agents, antistatic agents, surfactants, etc. or fibrous, platy, granular or powdery substances such as glass fiber, carbon fiber, metallic fiber, potassium titanate, glass flakes, glass beads, silica, mica, talc, wollastonite, calcium carbonate, titanium oxide, alumina, boron nitrile, ceramics and metallic powders. Such optional additives may be added in amounts which are not detrimental to printability. The base resin may also be colored by adding various dyes or pigments.

The addition of an inorganic filler is especially desirable in most cases because it generally contributes to an improvement in the heat resistance, for example, heat distortion temperature, of the resin and also improves its rigidity or durability to the high-temperature compressed gas employed according to this invention. Furthermore, it sometimes happens that the surface is suitably roughened by the addition of an inorganic filler, which results in improved adhesion of an ink.

It is also possible according to this invention to perform pretreatment, intermediate treatment or after treatment in order to improve various properties, namely, in order to improve printability or to relieve residual strain of the molding.

Examples of molding pretreatments include cleaning with a solvent or the like, surface activation treatments by heat treatment, UV or plasma radiation, etc., surface roughening treatment with acids, alkalis, solvents, etc., coating with base coats. Examples of molding intermediate treatments include suitable heating or cooling treatments after usual printing. Examples of molding aftertreatments include cleaning, heat treatment and coating with topcoats. Any of the above-noted treatments can be performed, if desired.

The foregoing description and Examples clearly show that the printing process of this invention makes it possible to impress and fix indicia or the like on a thermoplastic resin molding efficiently and economically within a very short time. The molding to which indicia or the like have been impressed has many excellent features, including excellent wear resistance properties, such that the indicia or the like do not fade after repeated uses, in addition to being free from bleeding thereby resulting in a sharp contrast of a very high practical value. In cooperation with many excellent properties inherent in a thermoplastic resin, the molding to which indicia or the like have been impressed according to the process of this invention has numerous possible utilities.

For example, when the thermoplastic resin is a polybutylene terephthalate resin or a polyacetal resin, the molding exhibits excellent physical, chemical and mechanical properties, slidability, moldability, etc. such, that it is suitably used for switches (such as light switches, and turn signal switches, washer switches), automobile parts (such as various control levers such as truck opener levers, and fuel lid opener levers), keys for personal computers, word processors and typewriters, electric or electronic components such as telephone set push buttons or other industrial parts.

EXAMPLES

The following nonlimiting examples will further describe this invention.

EXAMPLES 1 TO 10 AND COMPARATIVE EXAMPLES 1 TO 10

A polybutylene terephthalate (PBT) resin [Duranex 2000, a product of Polyplastics Co., Ltd.] and a composition formed by mixing this plastic with 20 wt.% (based on the total composition) of glass fiber were used as said thermoplastic resins, and these resins were injection-molded into flat plates (50 mm×70 mm×3 mm), which were used as test pieces.

Characters were impressed on these test pieces by the following method.

First, a test piece was degreased by ultrasonic cleaning in 1,1,1-trichloroethane and air-dried. Characters were printed on this test piece with a urethane-based ink [Type 14, a product of TDS, West Germany] by pad printing.

The ink was fixed by blowing a high-temperature compressed air against the printed area such that the temperature and pressure of the air on the printed area might be those shown in Table 1.

The test piece to which characters were impressed was evaluated on the following items.

① appearance

Bleeding of ink, sharpness of the boundary between a character and its surrounding, gloss and distortion of a molding, gloss and discoloration of ink, etc. were evaluated in terms of 10 ranks.

10 excellent ⟷ 1 poor

② heating/humidification test

The appearance, adhesion of ink, etc after treatment for ten days in a thermohygrostat of 80° C. and 95% RH were evaluated in terms of 10 ranks. The test result was actually judges by only the adhesion of the ink because the appearance after the treatment did not differ from that before the treatment in all cases.

10 excellent (no change) ⟷ 1 poor (the ink peeled)

③ wearing resistance

The apperance (collectively including contrast, bleeding of ink, peeling of ink, etc.) after rubbing 1000 times with a plastic eraser under a pressure of 500 g was evaluated in terms of 10 ranks.

10 excellent (no change) ⟷ 1 (the ink peeled or the characters were worn off)

④ peeling test with pencil

Peeling of ink with a lead of a pencil of HB to 4H (five reciprocal runs under a load of about 500 g). The result is represented in terms of the hardness of the pencil with which the peeling of ink occurs.

The results are shown in Table 1.

In the obtained test pieces to which characters were impressed, no bleeding of ink occurred, and the characters were well-defined, showed good contrast and were visually excellent. These features were scarcely injured even after they had been subjected to the heating-/humidification test and therefore were sufficiently durable.

For comparison, test pieces which were heat-treated in a dryer under conditions shown in Table 1 according to a conventional process after printing, and test pieces which were subjected to blowing of a high-temperature compressed gas under conditions outside the scope of this invention were similarly evaluated. The results are shown in Table 1. Like Examples 1 to 10, the test pieces on which characters were impressed by a conventional well-known process were excellent in appearance but poor in wearing resistance and could not withstand highly frequent repeated uses. Further, the test pieces against which a high-temperature compressed gas was blown under conditions outside the scope of this invention were poor in wearing resistance or appearance, i.e., gloss reduction of a molding, discoloration of ink, etc. and therefore were of little practical value.

EXAMPLES 11 TO 19 AND COMPARATIVE EXAMPLES 11 TO 21

A polyacetal (POM) resin [Duracon M 90-02, a product of Polyplastics Co., Ltd.] or a composition formed by mixing this resin with 20 wt.% (based on the total composition) of glass fiber were used as the thermoplastic resins. Characters were printed on the moldings by the same process as that of Examples 1 to 10 and evaluated. Blowing of a high-temperature compressed gas after printing was performed under the conditions (the temperature and the pressure were those on the printed area) shown in Table 2. For comparison, test pieces which were heated in a dryer according to a conventional process and test pieces against which a high-temperature compressed gas was blown under conditions outside the scope of this invention were also evaluated.

The results were shown in Table 2.

TABLE 1

| | | Examples | | | | | | | | | |
|---|---|---|---|---|---|---|---|---|---|---|---|
| | | 1 | 2 | 3 | 4 | 5 | 6 | 7 | 8 | 9 | 10 |
| Resin composition | PBT resin (wt. %) | 100 | 100 | 100 | 100 | 100 | 100 | 100 | 100 | 80 | 80 |
| | glass fiber (wt. %) | — | — | — | — | — | — | — | — | 20 | 20 |
| Ink | | urethane-base | urethane-base | urethane-base | urethane-base | urethane-base | urethane-base | urethane-base | urethane-base | urethane-base | urethane-base |
| Conditions of heating after printing | temperature (°C.) | 150 | 150 | 200 | 200 | 200 | 200 | 230 | 270 | 200 | 200 |
| | pressure (kg/cm$^2$) | 0.5 | 2.0 | 0.5 | 0.5 | 0.2~2.0 | 5.0 | 0.5 | 0.5 | 0.5 | 0.5 |
| | time (sec) | 5~60 | 5~60 | 5~40 | 60~90 | 10 | 10 | 10 | 10 | 10 | 60 |
| Evaluation | ① appearance | 10 | 10 | 10 | 8*1 | 10 | 8*1 | 10 | 7*2 | 10 | 10 |
| | ② heating/humidification test | 9 | 9 | 10 | 10 | 10 | 10 | 10 | 10 | 10 | 10 |
| | ③ wearing resistance | 9 | 10 | 10 | 10 | 10 | 10 | 10 | 10 | 10 | 10 |
| | ④ peeling test with pencil | 2H~4H | >4H | >4H | >4H | >4H | >4H | >4H | >4H | >4H | >4H |

*1The gloss of molding slightly decreased.
*2The gloss of molding slightly decreased.
Ink slightly discolored.

| | | Comparative Examples | | | | | | | | | |
|---|---|---|---|---|---|---|---|---|---|---|---|
| | | 1 | 2 | 3 | 4 | 5 | 6 | 7 | 8 | 9 | 10 |
| Resin composition | PBT resin (wt. %) | 100 | 100 | 100 | 100 | 100 | 100 | 100 | 80 | 80 | 80 |
| | glass fiber (wt. %) | — | — | — | — | — | — | — | 20 | 20 | 20 |
| Ink | | urethane- | urethane- | urethane- | urethane- | urethane- | urethane- | urethane- | urethane- | urethane- | urethane- |

TABLE 1-continued

| | | | | | | | | | | | |
|---|---|---|---|---|---|---|---|---|---|---|---|
| | | base | base | base | base | base | base | base | base | base | base |
| Conditions of heating after printing | temperature (°C.) | 150 | 150 | 200 | 200 | 80 | 350 | 200 | 150 | 200 | 200 |
| | pressure (kg/cm²) | 0 | 0 | 0 | 0 | 0.5~5.0 | 0.5 | 7.0 | 0 | 0 | 0 |
| | time (sec) | 30~60 | 1800 | 10~30 | 300 | 10~120 | 10 | 10 | 1800 | 10~30 | 300 |
| Evaluation | ① appearance | 10 | 10 | 10 | 8*1 | 10 | 2*3 | 3*4 | 10 | 10 | 10 |
| | ② heating/humidification test | 1 | 6 | 1 | 5 | 1 | 10 | 10 | 7 | 1 | 6 |
| | ③ wearing resistance | 1 | 7 | 1~2 | 7 | 2 | 10 | 10 | 7 | 1~2 | 7 |
| | ④ peeling test with pencil | HB> | HB~2H | HB> | HB~2H | HB> | >4H | >4H | ≈2H | HB> | ≈2H |

*1The same as before
*3The molding partly fused, and the ink discolored
*4The gloss of molding decreased, and the ink diffused

TABLE 2

| | | Examples | | | | | | | | |
|---|---|---|---|---|---|---|---|---|---|---|
| | | 11 | 12 | 13 | 14 | 15 | 16 | 17 | 18 | 19 |
| Resin composition | POM resin (wt. %) | 100 | 100 | 100 | 100 | 80 | 100 | 100 | 100 | 100 |
| | glass fiber (wt. %) | — | — | — | — | 20 | — | — | — | — |
| Ink | | urethane-base | urethane-base | urethane-base | urethane-base | urethane-base | epoxy-base | epoxy-base | phenol-base | alkyd-base |
| Conditions of heating after printing | temperature (°C.) | 150 | 200 | 200 | 230 | 200 | 150 | 200 | 150 | 150 |
| | pressure (kg/cm²) | 0.5 | 0.5 | 0.2~2.0 | 0.5 | 0.5 | 0.5 | 0.5 | 0.5 | 0.5 |
| | time (sec) | 5~60 | 5~30 | 10 | 10 | 10~60 | 30 | 10 | 30 | 30 |
| Evaluation | ① appearance | 10 | 10 | 10 | 10 | 10 | 10 | 10 | 10 | 10 |
| | ② heating/humidification test | 9 | 10 | 10 | 10 | 10 | 8 | 9 | 9 | 8 |
| | ③ wearing resistance | 10 | 10 | 10 | 10 | 10 | 9 | 10 | 10 | 9 |
| | ④ peeling test with pencil | 2H~4H | >4H | >4H | >4H | >4H | ≈2H | ≈2H | 2H~4H | ≈2H |

| | | Comparative Examples | | | | | | | | | | |
|---|---|---|---|---|---|---|---|---|---|---|---|---|
| | | 11 | 12 | 13 | 14 | 15 | 16 | 17 | 18 | 19 | 20 | 21 |
| Resin composition | POM resin (wt. %) | 100 | 100 | 100 | 100 | 100 | 100 | 100 | 80 | 100 | 100 | 100 |
| | glass fiber (wt. %) | — | — | — | — | — | — | — | 20 | — | — | — |
| Ink | | urethane base | urethane base | urethane base | urethane base | urethane base | urethane base | urethane base | urethane base | epoxy-base | phenol-base | alkyd-base |
| Conditions of heating after printing | temperature (°C.) | 150 | 150 | 200 | 200 | 80 | 350 | 200 | 150 | 150 | 150 | 150 |
| | pressure (kg/cm²) | 0 | 0 | 0 | 0 | 0.5 | 0.5 | 7.0 | 0 | 0 | 0 | 0 |
| | time (sec) | 60 | 1800 | 30 | 300 | 30 | 10 | 10 | 1800 | 1800 | 1800 | 1800 |
| Evaluation | ① appearance | 10 | 10 | 10 | 1*5 | 10 | 1*5 | 1*6 | 10 | 10 | 10 | 10 |
| | ② heating/humidification test | 1 | 5 | 1 | — | 1 | — | 10 | 6 | 5 | 5 | 4 |
| | ③ wearing resistance | 1 | 7 | 1 | — | 1 | — | 10 | 8 | 6 | 7 | 6 |
| | ④ peeling test with pencil | HB> | ≈2H | HB> | — | HB> | — | >4H | ≈2H | HB~2H | ≈2H | HB~2H |

*5The entire molding or the printed area fused considerably heavily.
*6The printed area deformed or softened, and the molding could not be actually used.

I claim:

1. A method of making a thermoplastic resin article having printed indicia fixed on at least one surface thereof, comprising the steps of:

(a) applying liquid printing media in the form of preselected indicia upon at least one surface of a molded article which consists essentially of a crystalline thermoplastic resin selected from the group consisting of polyester resin, polyacetal resins, polyphenylene sulfide resins and polyamide resins; and then (b) fixing said applied liquid printing media in the form of said indicia by (i) directing, towards said at least one surface having said applied liquid printing media thereon, a flow of gas at a pressure of between 0.05 to 5 kg/cm² and at a temperature between 100° to 300° C. which is greater than a softening temperature of said resin, and (ii) maintaining said directed flow of gas in contact with said at least one surface for a time between 1 to 120 seconds sufficient to dry said applied liquid printing media and to fix the same onto said at least one surface, yet insufficient to cause distortion and/or discoloration of said molded thermoplastic resin article, whereby said thermoplastic resin article having printed indicia thereupon is obtained.

2. A method as in claim 1, wherein said liquid printing media is selected from the group consisting of ink, dye and paint.

3. A method as in claim 1, wherein said thermoplastic resin article consists essentially of polybutylene terephthalate resin.

4. A process as in claim 1, wherein step (b) is practiced using a flow of gas at a pressure between 0.1 to 3 kg/cm² and a temperature between 150° to 250° C.

* * * * *

UNITED STATES PATENT AND TRADEMARK OFFICE

CERTIFICATE OF CORRECTION

PATENT NO. : 4,903,601

DATED : February 27, 1990

INVENTOR(S) : Kiichiro FUKUI

It is certified that error appears in the above-identified patent and that said Letters Patent is hereby corrected as shown below:

Column 1, line 13, after "impart" delete the comma (,);
line 24, change "moldings" to --molding's--;
line 28, after "resins" insert a comma (,);
line 34, after "normal" delete "and at normal" and insert --temperature and--;
line 40, after "minutes," insert --is required--;
line 48, after "printing" delete the comma (,);
line 54, after "tively," delete "or the like".

Column 2, line 20, after "the" (first occurrence) delete "line" and insert --time needed-- and after "dry" insert --the--;
line 27, after "quently" delete "occur frequently" and insert --occur--;
line 50, after "seconds" insert --according to--.

Column 3, line 38, after "present" delete "within" and insert --invention--.

Signed and Sealed this

Fifth Day of March, 1991

*Attest:*

*Attesting Officer*

HARRY F. MANBECK, JR.

*Commissioner of Patents and Trademarks*